US006244017B1

(12) United States Patent
Focke et al.

(10) Patent No.: US 6,244,017 B1
(45) Date of Patent: Jun. 12, 2001

(54) PACKAGING CONTAINER FOR CIGARETTES PLUS METHOD AND DEVICE FOR MANUFACTURING SAME

(75) Inventors: Heinz Focke, Verden; Henry Buse, Visselhövede, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/161,380

(22) Filed: Sep. 28, 1998

(30) Foreign Application Priority Data

Sep. 30, 1997 (DE) ..... 197 43 120

(51) Int. Cl.[7] ..... B65B 21/06

(52) U.S. Cl. ..... 53/147; 53/153; 53/238

(58) Field of Search ..... 206/831, 256, 206/257, 258; 53/466, 147, 153, 238, 155

(56) References Cited

U.S. PATENT DOCUMENTS

| | | | | |
|---|---|---|---|---|
| 1,923,452 | | 8/1933 | Neumiller . | |
| 2,969,629 | * | 1/1961 | Blais | 53/155 |
| 3,027,998 | | 4/1962 | Ridgway . | |
| 3,278,016 | | 10/1966 | Conti . | |
| 3,695,422 | * | 10/1972 | Tipodi | 206/831 |
| 3,721,335 | * | 3/1973 | Grant | 206/256 |
| 3,832,823 | | 9/1974 | Currie . | |
| 3,832,832 | | 9/1974 | Hoon, Jr. . | |
| 4,620,664 | * | 11/1986 | Kaufman et al. | 206/831 |
| 4,784,261 | | 11/1988 | Kutchin . | |
| 5,214,901 | | 6/1993 | Milliner . | |
| 5,375,704 | * | 12/1994 | Focke et al. | 206/831 |
| 5,481,848 | * | 1/1996 | Tagliaferri et al. | 53/238 |

FOREIGN PATENT DOCUMENTS

| | | |
|---|---|---|
| 610986 | 2/1935 | (DE) . |
| 1118810 | 8/1965 | (DE) . |
| 23 38 737 | 2/1975 | (DE) . |
| 296 08 305 U | 9/1996 | (DE) . |
| 195 13 953 | 10/1996 | (DE) . |
| 446494 | 9/1991 | (EP) . |
| 709306 | 5/1996 | (EP) . |
| 296143 | 8/1928 | (GB) . |
| 1 603 537 | 11/1981 | (GB) . |

* cited by examiner

*Primary Examiner*—Eugene Kim
(74) *Attorney, Agent, or Firm*—Sughrue, Mion, Zinn, Macpeak & Seas, PLLC

(57) ABSTRACT

Packaging container for cigarettes, in which a group of cigarette packets (10), namely two rows of packets (12, 13), is surrounded by an outer wrapping (11) made of paper, foil or other packaging material. A coupon (30)is added to the packaging container, namely a print carrier with advertising or other printing on it. The large-area coupon (30) extends over a plurality of cigarette packets (10), for example three, and is arranged at the side between a (front) wall (20) and the group of cigarette packets (10) or between the latter, namely between rows of packets (12, 13).

8 Claims, 9 Drawing Sheets

PACKAGING CONTAINER FOR CIGARETTES PLUS METHOD AND DEVICE FOR MANUFACTURING SAME

BACKGROUND OF THE INVENTION

The invention relates to a packaging container for a group of cigarette packets which is surrounded by an outer wrapping. In addition, the invention relates to a method and device for manufacturing packaging containers of this sort.

Packaging containers for cigarettes—so-called cigarette cartons—consist of a group of generally ten cigarette packets which are formed in two rows. Large-area packet sides, namely front side and rear side, here lie beside one another. The outer wrapping can consist of paper, (thin) cardboard, or (transparent) plastic film. Packaging containers for other small packets can be configured in the same way, for example packaging containers for packets of paper handkerchiefs.

With packets of this or a similar type, there is often the necessity of conveying information to customers or consumers. This information can frequently be of different content or require different languages.

SUMMARY OF THE INVENTION

The purpose underlying the invention is so to configure a packaging container for cigarette packets in particular that, with very little outlay, any kind of information instructions or the like, extensive if necessary, can be given.

In fulfilment of this purpose, the packaging container according to the invention is characterised in that inside the packaging container there is disposed at least one separate blank with printing on it, namely a coupon which extends over at least two adjacent cigarette packets.

According to the invention, there is accordingly added to the packaging container a comparatively large-area print carrier or coupon which can extend inside the packaging container on its outer side, especially where there is a wrapping of transparent material. Alternatively or in addition, the coupon can, on a usual packaging container for cigarettes, be positioned between two rows of packets, preferably in the middle.

The coupon here extends preferably over three adjacent cigarette packets and is slightly smaller in height than the height of the cigarette packets. In addition, a coupon or print carrier can be configured U-shaped, i.e. can extend cornerwise, in the region of an end wall of the packaging container or in the centre transversely across the two rows of packets.

When a packaging container with a coupon or a print carrier is manufactured, preferably the group of cigarette packets is first assembled and then the blank or coupon led in. The unit is then surrounded by the outer wrapping. Where the coupon is disposed between the rows of packets, according to the invention a number of cigarette packets of an (upper) row of packets corresponding to the dimension of the coupon is raised up, without the cigarette packets leaving the formation of the row of packets. In this way, a gap is produced into which the coupon can be introduced.

The device according to the invention consists of a magazine for the print carriers. Print carriers are taken out of this device in succession and are conveyed by a coupon conveyor into position on the group of cigarette packets or between the rows of same.

Further details of the invention relate to the design of the packaging container, the method for manufacturing same and to the device for leading in and introducing the print carrier into the packaging container.

Embodiments of the packaging container and of the device for manufacturing same or for leading in the print carrier are explained in greater detail below with the aid of the drawings. These show:

DESCRIPTION OF PREFERRED EMBODIMENTS

Figure 1:
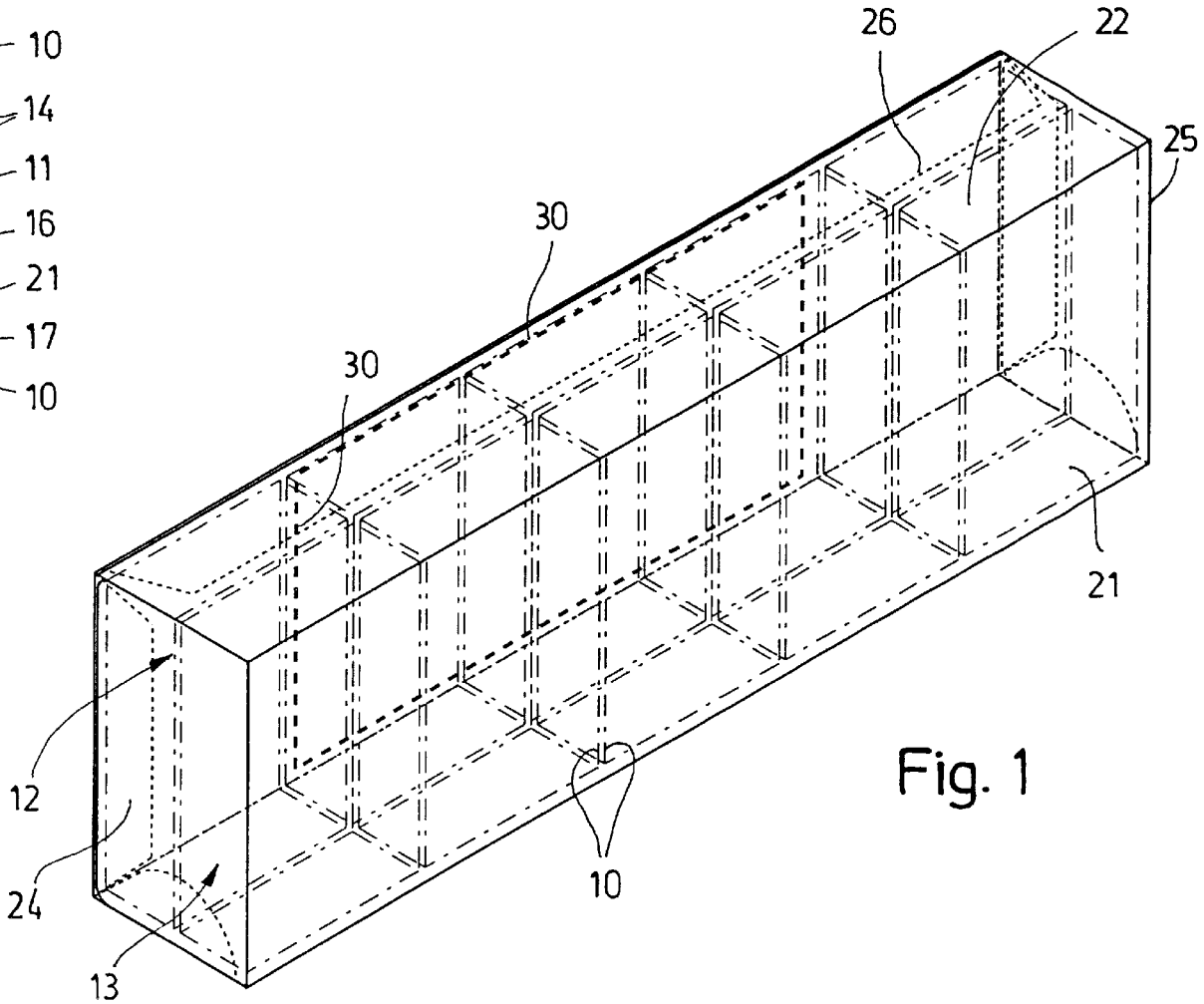
FIG. 1 a packaging for cigarettes in perspective view.

The drawings relate to so-called cigarette cartons. A group of cigarette packets 10—in the present case embodied as hinge-lid packets—is surrounded on all sides by an outer wrapping 11. The outer wrapping 11 can, for example, consist of a blank 19 as per FIG. 5.

This in turn is formed from (thin) cardboard. Alternatively, the outer wrapping 11 can consist of paper or foil, or also of transparent plastic film.

The cigarette packets 10 are disposed in an ordered formation, namely in two rows of packets 12, 13. Inside the two rows of packets 12, 13, adjacent cigarette packets 10 lie from packet row 12 to packet row 13 with large-area front sides 14 and rear sides 15 against one another. The hinge-lid packets consist of a packet portion 16 and a lid 17. Inside a row of packets 12, 13, the cigarette packets 10 lie with upright narrow side surfaces 18 against one another.

The group consisting of ten cigarette packets 10—five cigarette packets in each row of packets 12, 13—is wrapped by the blank 19 in such a way that a front wall 20, rear wall 21, side walls 22, 23 and end walls 24, 25 are produced. In the region of a side wall 22, the outer wrapping 11 is provided with a seal. The latter consists, on the present embodiment, of overlapping the side wall 22 with a connecting flap 26. Side wall 22 and connecting flap 26 are connected to one another by gluing. If a tax mark is to be applied to a base surface 27 of the cigarette packets 10 which face the side wall 22, the side wall 22 is to this end detached from the connecting flap 26 and the outer wrapping 11 opened in this way. In this case, a corresponding adhesive is used ("stick-no-stick"). On cigarette packets 10 embodied as hinge-lid packets, with a configuration of the packaging container of this kind, the lid 17 faces the opposite closed side wall 23.

Figure 5:
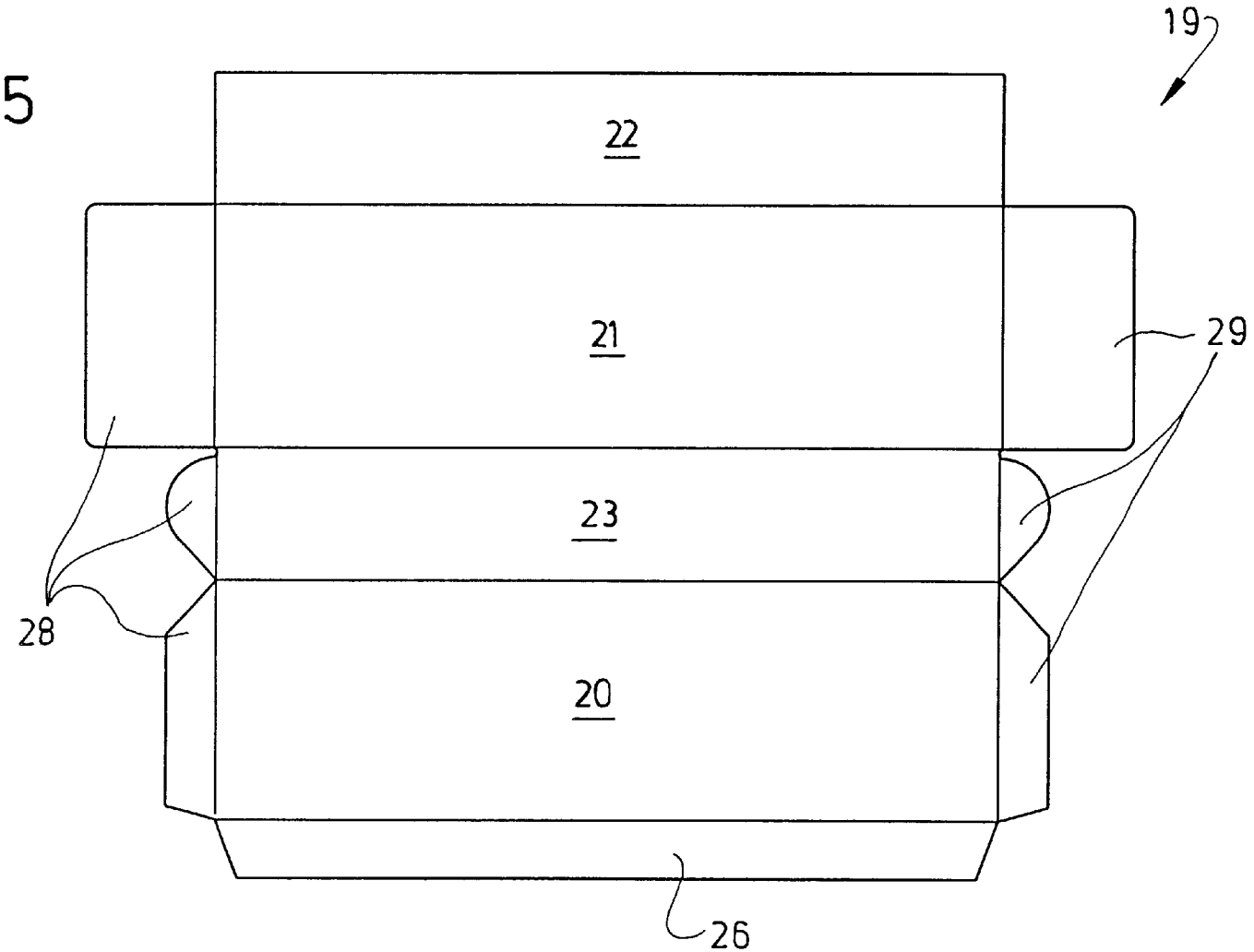

On the blank 19 according to FIG. 5, the end walls 24, 25 consist of end wall flaps 28, 29 configured in a special way. The cigarette packets 10 are so positioned that the lids 17 face away from the closing side (side wall 22).

Inside the packaging container there is disposed a print carrier formed from a separate blank, which is referred to below as a "coupon" 30. This is a rectangular thin-walled blank, made especially of paper or (thin) cardboard. The coupon 30 can be provided on one side or on both sides with printing. The printing is particularly information, advertising or even decorative. The coupon 30 can be used as a voucher for participating in competitions.

Figure 2:
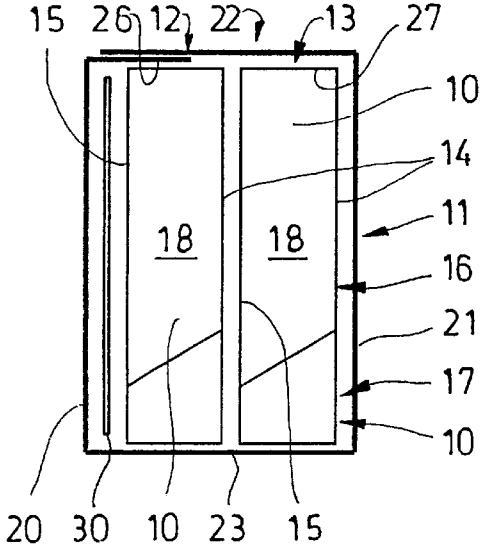
FIG. 2 the packaging container according to FIG. 1, in cross-section.

According to FIG. 1 and FIG. 2, the coupon 30 is positioned between the front wall 20 of the outer wrapping 11 and the group of cigarette packets 10. The coupon 30 is here of such dimensions that it extends approximately over the height of the packaging container, i.e. over the height of the cigarette packets 10. In the longitudinal direction, the rectangular coupon is greater than an individual cigarette packet 10 or than the front side 14 of same.

What is advantageous is a dimension in which the coupon 30 extends approximately over three cigarette packets 10 or over three front sides 14 of same. The coupon 30, in relation to the longitudinal extension of the packaging container, is disposed centrally inside same.

Figure 3:
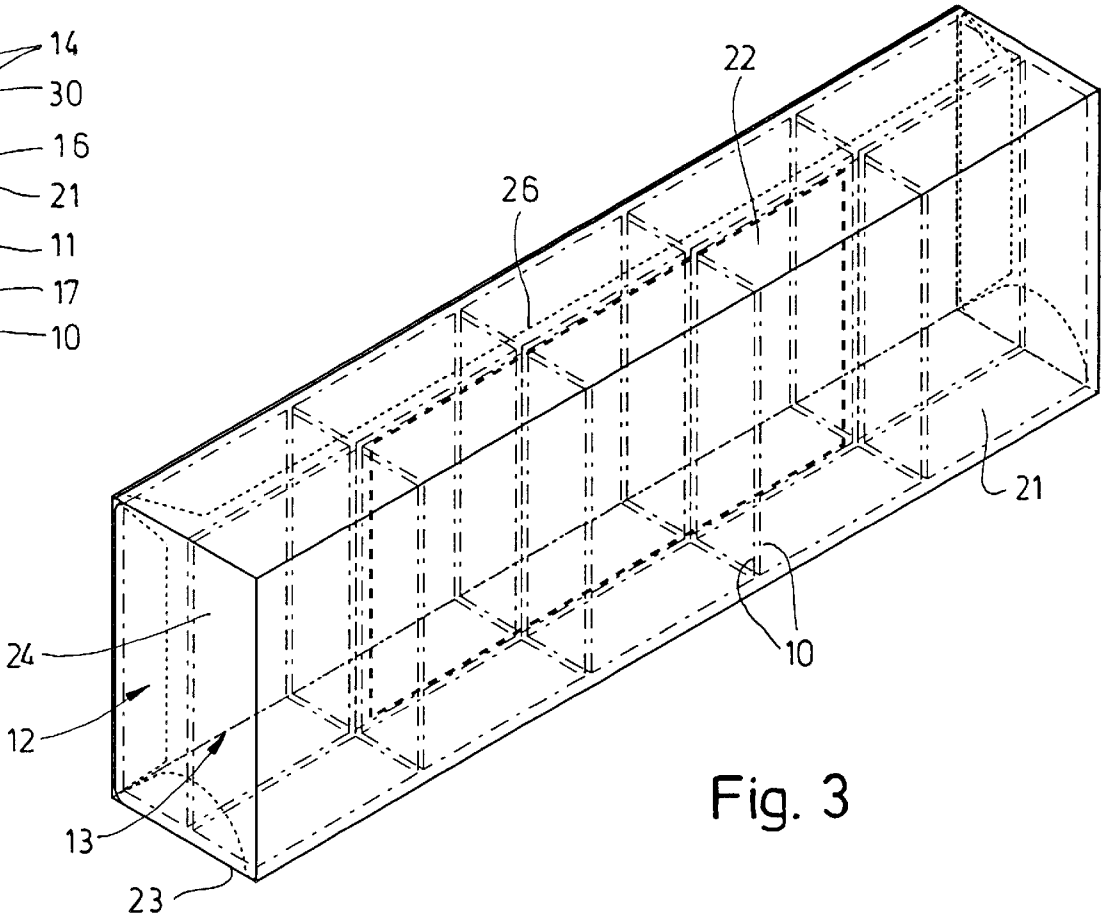
FIG. 3 a view analogous to FIG. 1 of a different embodiment of a packaging container, FIG. 4 a cross-section of the packaging container according to FIG. 3, FIG. 5 a blank for an outer wrapping of a packaging container according to FIG. 1 and FIG. 3, FIG. 6 a device for manufacturing packaging containers according to FIG. 1 and FIG. 2, in schematic side view, FIG. 7 a detail of the device according to FIG. 6, in plan view, FIG. 8 a detail of a device for manufacturing packaging containers according to FIG. 3, in side view, in partial vertical section, FIG. 9 a device according to FIG. 8 with further details, with the units in an altered position, FIG. 10 device according to FIG. 8 and FIG. 9, in simplified plan view, FIG. 11 a packaging container for cigarettes in plan view, in partial detail, FIG. 12 a further embodiment of a packaging container with a coupon, in plan view, in partial detail, FIG. 13 a perspective end view of the embodiment as per FIG. 11, FIG. 14 a perspective view of a portion of the packaging container according to FIG. 12.
Figure 4:
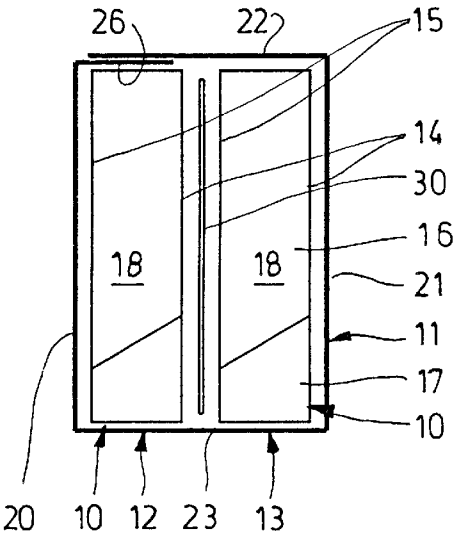

On the design according to FIG. 3 and FIG. 4, the coupon 30 is disposed between the two rows of packets 12, 13. The relative position is chosen to be such that the coupon 30 is positioned in the middle of a gap between the rows of packets 12, 13, and extends approximately over three cigarette packets 10 at a height which is slightly smaller than the height of the cigarette packets.

The coupon 30 is preferably disposed loose inside the packaging container, i.e. is not glued to the outer wrapping 11 or the cigarette packets 10. When the packaging container is opened, the coupon 30 can be taken out and used as appropriate.

The procedure during the manufacture of the packaging container is expediently such that first of all the cigarette packets 10 are arranged in the formation of the packaging container, then the coupon 30 is applied in the correct position on the cigarette packets 10, and then the unit consisting of cigarette packets 10 and coupon 30 is wrapped in the blank 19.

Figure 6:
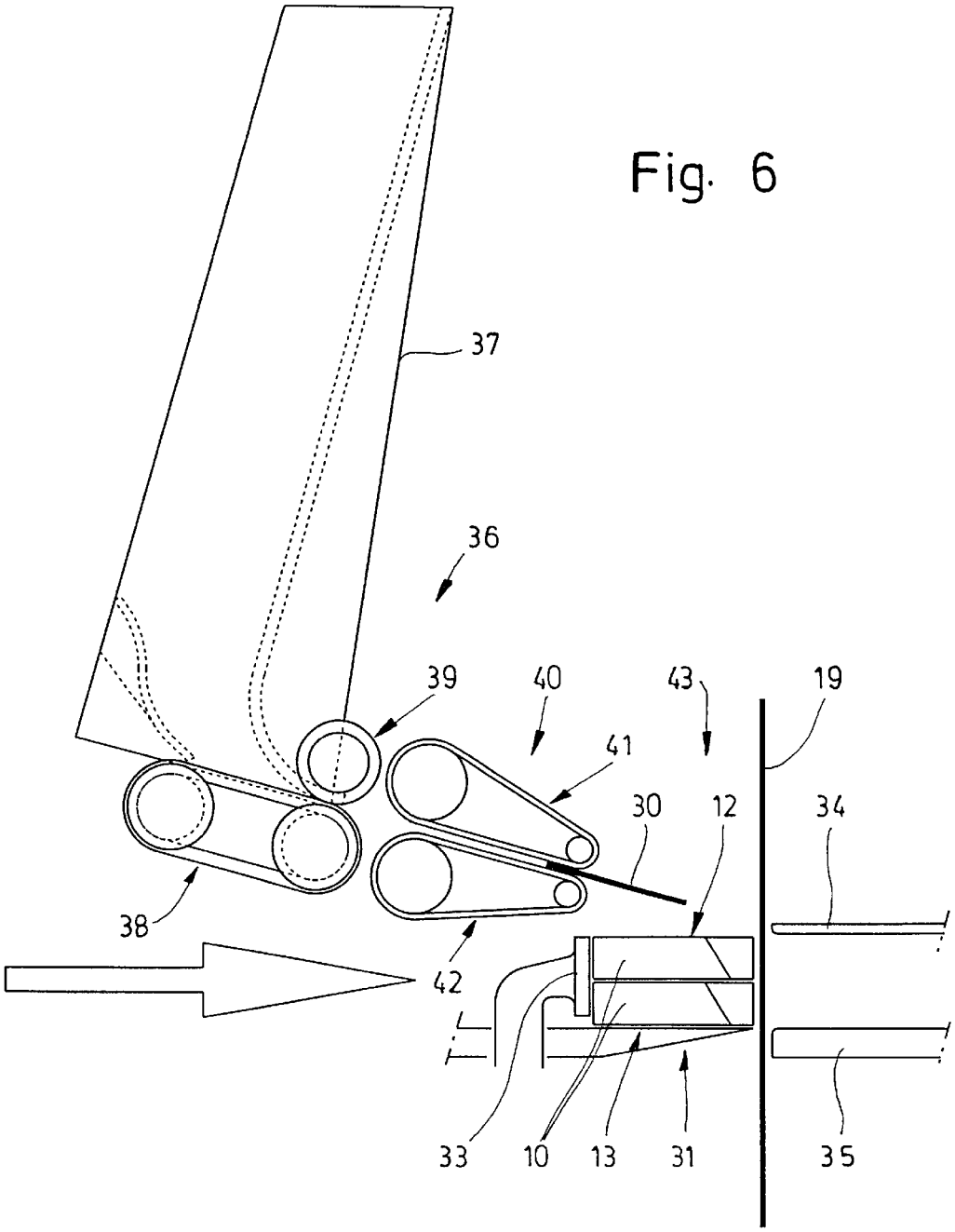
Figure 7:
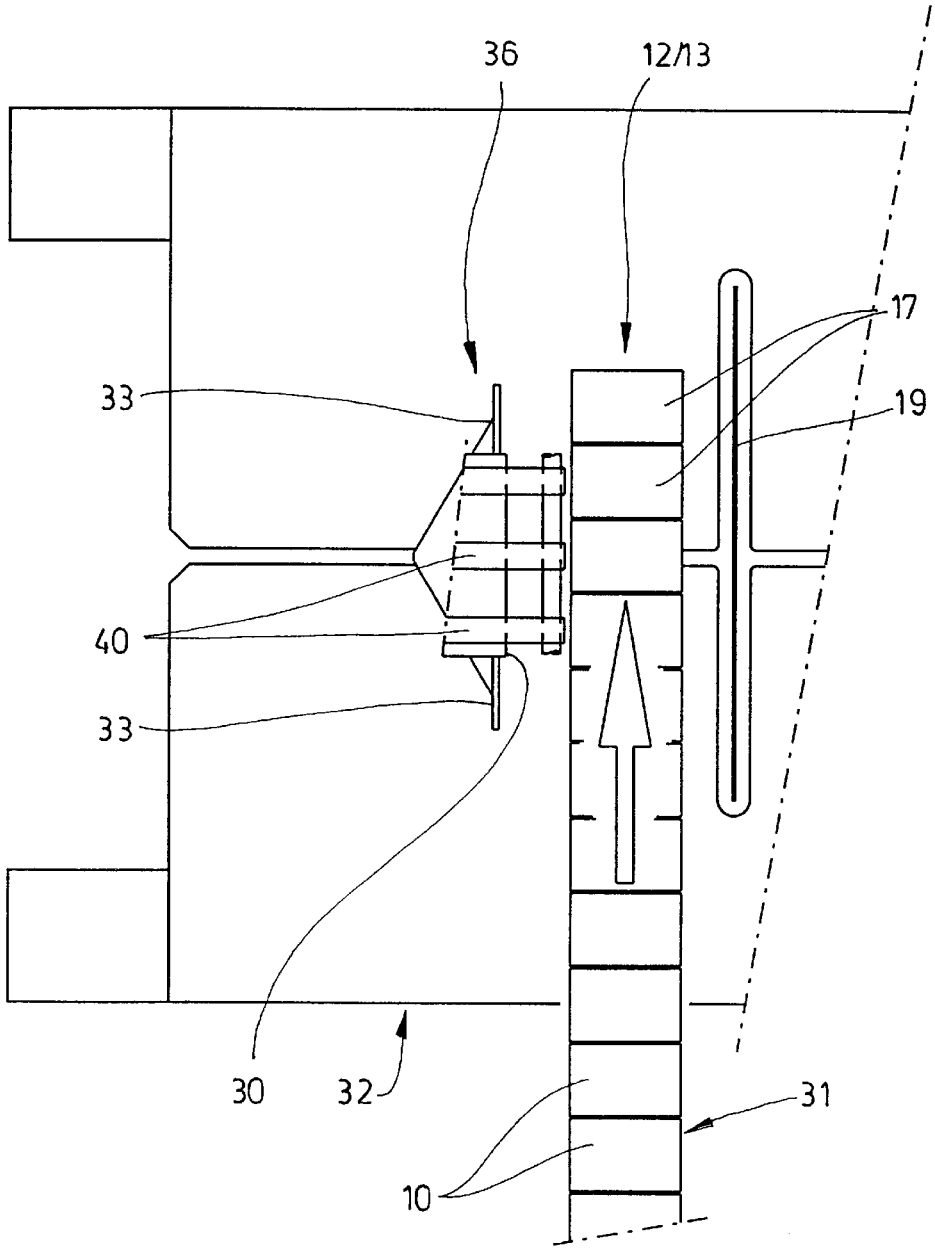

The device according to FIG. 6 and FIG. 7 can be used for the manufacture of a packaging container according to FIG. 1 and FIG. 2. The cigarette packets 10 are transported in as a continuous line of packets 31 in two rows of packets lying one above the other 12, 13—corresponding to their position in the packaging container. In the region of a platform 32, a group of cigarette packets 10, corresponding to the contents of the packaging container, is expelled by a slide 33 in a transverse direction. The blank 19 is held in readiness parallel to the line of packets 31 and thus transversely to the expulsion direction of the slide 33, in an upright plane. The group of cigarette packets 10 is conveyed through the plane of the blank 19, said blank being caught up by the cigarette packets 10. By being inserted into an upper guide 34 and a lower guide 35, the blank 19 is laid in a U-shape around the group of cigarette packets 10. The lids 17 of the cigarette packets 10, pointing forwards in the direction of expulsion, are here adjacent to the side wall 23.

Before the group of cigarette packets 10 is expelled transversely, the coupon 30 is led in and placed in the correct position on the upper side of the cigarette packets 10 which are to be expelled. To this end, there is arranged above the platform 32 or above the line 31 of cigarette packets 10, a coupon assembly 36. This consists of a coupon magazine 37 in which the prepared coupons 30 are stacked above one another. On the lower side, the coupons 30 can be taken out individually by a removal conveyor 38 in conjunction with a counter roller 39.

The coupons 30 removed from the coupon magazine 37 are transferred to a coupon dispenser 40. The latter consists of two conveyer belts 41, 42. The coupon 30 is transported between facing bights. The conveyor belts 41, 42 or their hoistways, are inclined downwards in the conveying direction. The coupon 30 is therefore transported in a plane which is inclined obliquely downwards, in a direction towards the upper side of the cigarette packets 10. The relative position of the coupon dispenser 40 is chosen to be such that the coupon 30 is laid in the described relative position on the upper side of three adjacent cigarette packets 10. Thereafter, the unit consisting of cigarette packets 10 and coupon 30 is dispelled in the described manner to be wrapped up in the blank 19.

Figures 8, 9:
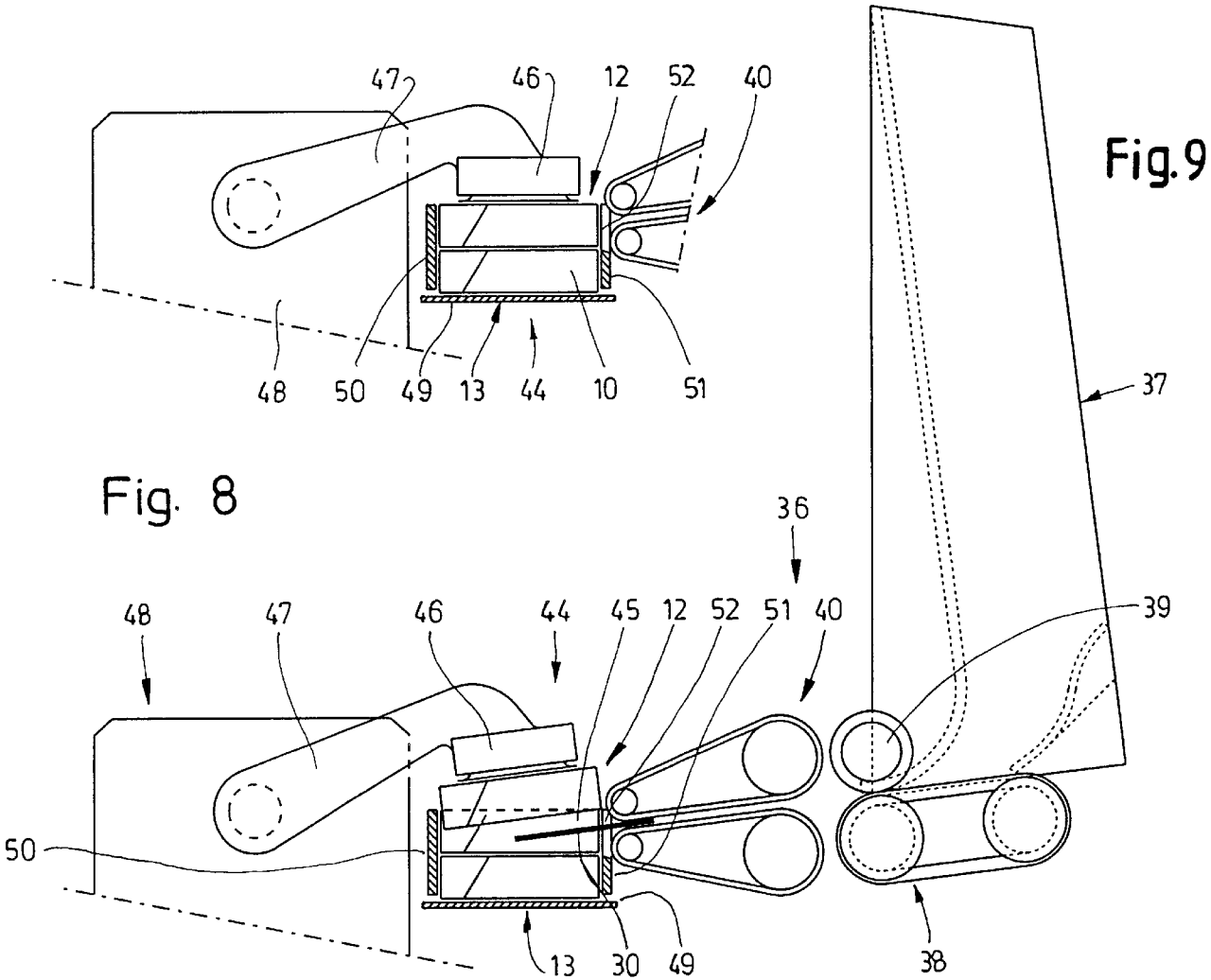
Figure 10:
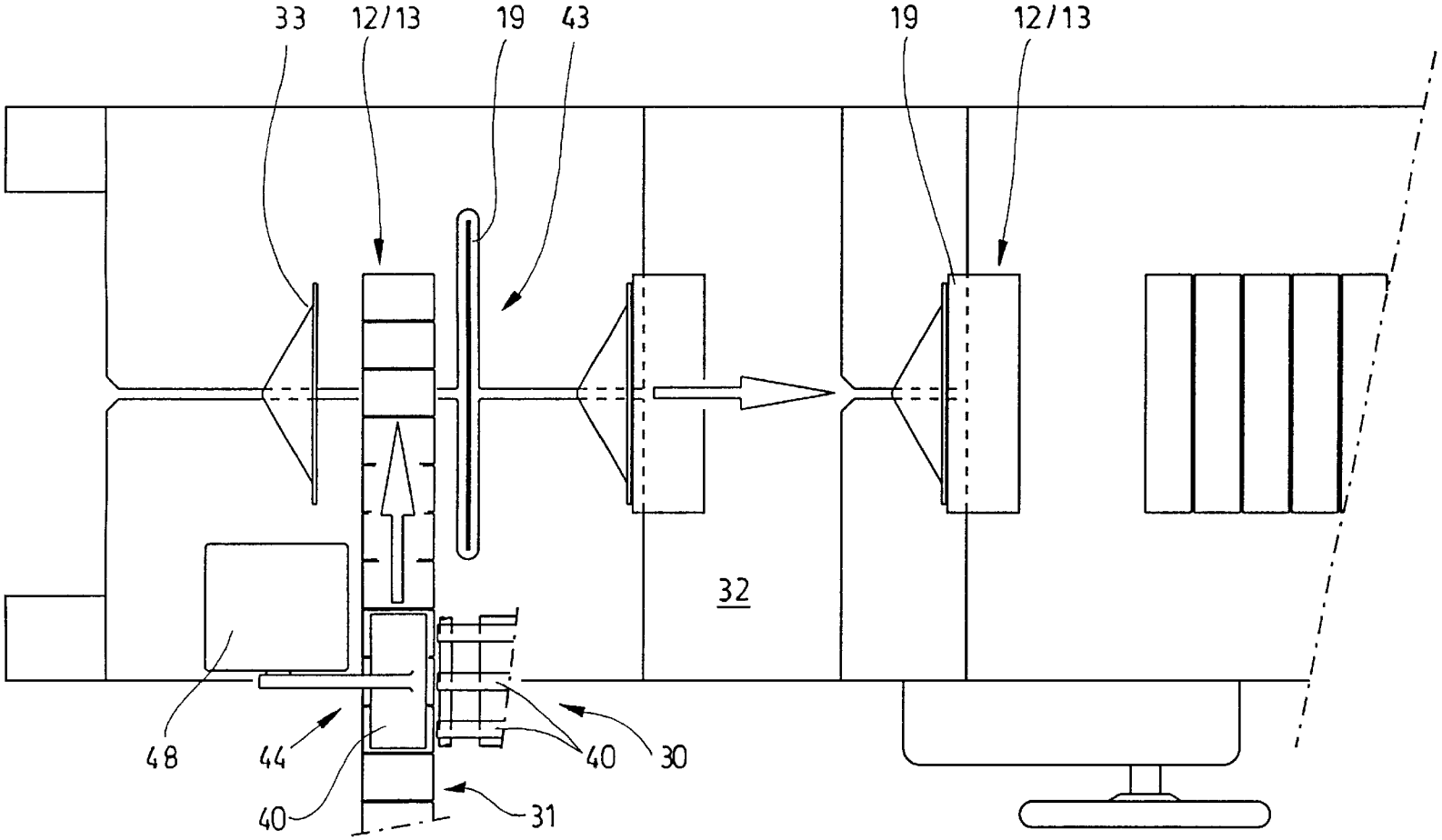

The device according to FIG. 8, FIG. 9 and FIG. 10 is specially suitable for positioning coupons 30 in the manner of the embodiment according to FIG. 3 and FIG. 4. Here, too, the procedure is that the coupon 30 is first applied, in the correct position for the packet, to the group of cigarette packets 10 and then the unit consisting of cigarette packets 10 and coupon 30 is led to the blank which is held in readiness for the outer wrapping 11.

As can be seen especially from FIG. 10, the line of packets 31 is led to an expulsion station 43 in the region of the platform 32. A coupon station 44 is placed in front of the expulsion station 43 in the direction of conveying. In the region of said coupon station, the coupon 30 is in each case applied in the required position, namely between the cigarette packets 10 of the rows of packets 12, 13.

To this end, the cigarette packets 10 in the two rows 12, 13 are moved intermittently away from one another in the region of the coupon station 44, such that an insertion gap 45 for the coupon 30 is formed, open at the side. To this end, the necessary number of cigarette packets 10—in the present case three—of the upper row of packets 12 is lifted from the lower row of packets 13. The (three) cigarette packets 10 are here moved into an inclined position, such that a wedge- or funnel-shaped insertion gap 45 is formed. The cigarette packets, however, do not here leave the formation of the line of packets 31 or the row of packets 12. Rather, the raised cigarette packets 10 remain between the remaining horizontally-aligned packets of the row of packets.

Adjacent to the insertion gap 45 thus formed is disposed the coupon assembly 36 in the embodiment described. The coupon dispenser 40 is positioned directly adjacent to the rows of packets 12, 13 lying above one another, in a relative position such that a coupon 30 led in reaches the insertion gap 45 and thus the desired position between the two rows of packets 12, 13. The raised cigarette packets 10 of the upper row 12 are moved back into their normal position after the coupon 30 has been inserted.

In the region of the coupon station 44 there is located, above the rows of packets 12, 13, a lifting member, namely a lifting head 46 to which suction air can be applied. This head is of such dimensions that respectively three adjacent cigarette packets 10 within row 12 are grasped and lifted up in one lifting operation. The lifting head,46 is attached to a swivel arm 47, which in turn is connected with a control mechanism 48.

The line of packets 31 formed from the rows of packets 12, 13 is transported on a conveyer, for example on a belt 49. Stationary side guides 50, 51 are disposed at the side. On the side facing the coupon assembly 36, the side guide 51 is interrupted or provided with an aperture 52 which makes it possible for the coupon 30 to pass through.

Figure 11:
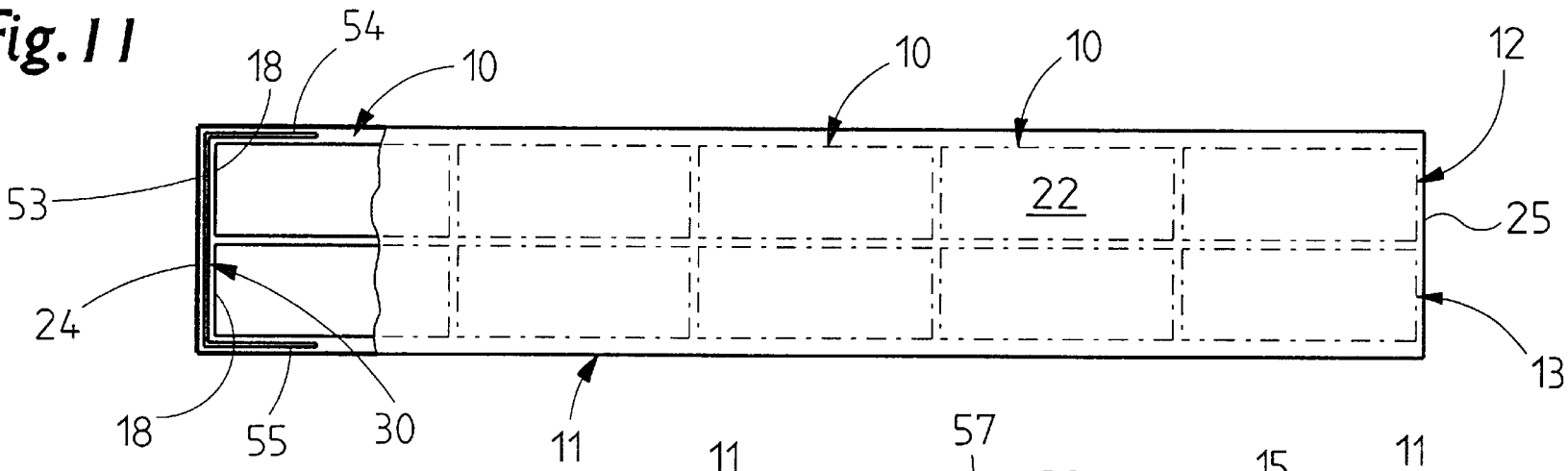
Figure 13:
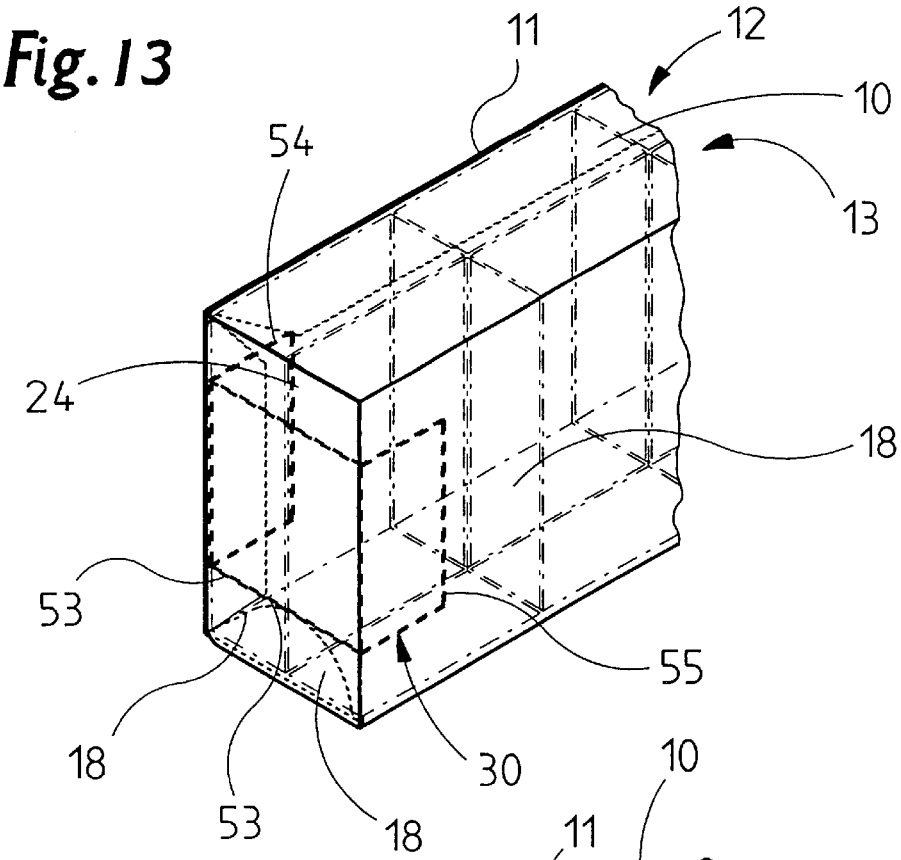

A further embodiment for the design of a packaging container for cigarettes arises from FIG. 11 and FIG. 13. A longish rectangular coupon 30 is positioned in the region of an end wall 24 of the elongated container between the outer wrapping 11 and the group of cigarette packets 10, "cornerwise". The coupon 30 is disposed in a U-shape, half-way up or in the centre of the end wall 24. A web 53 extends transversely over the end wall 24, i.e. over side surfaces 18 of two adjacent cigarette packets 10. One leg 54 each of the U-shape is located in the region of a front side 14 or rear side 15 of the end cigarette packets 10.

Figure 12:
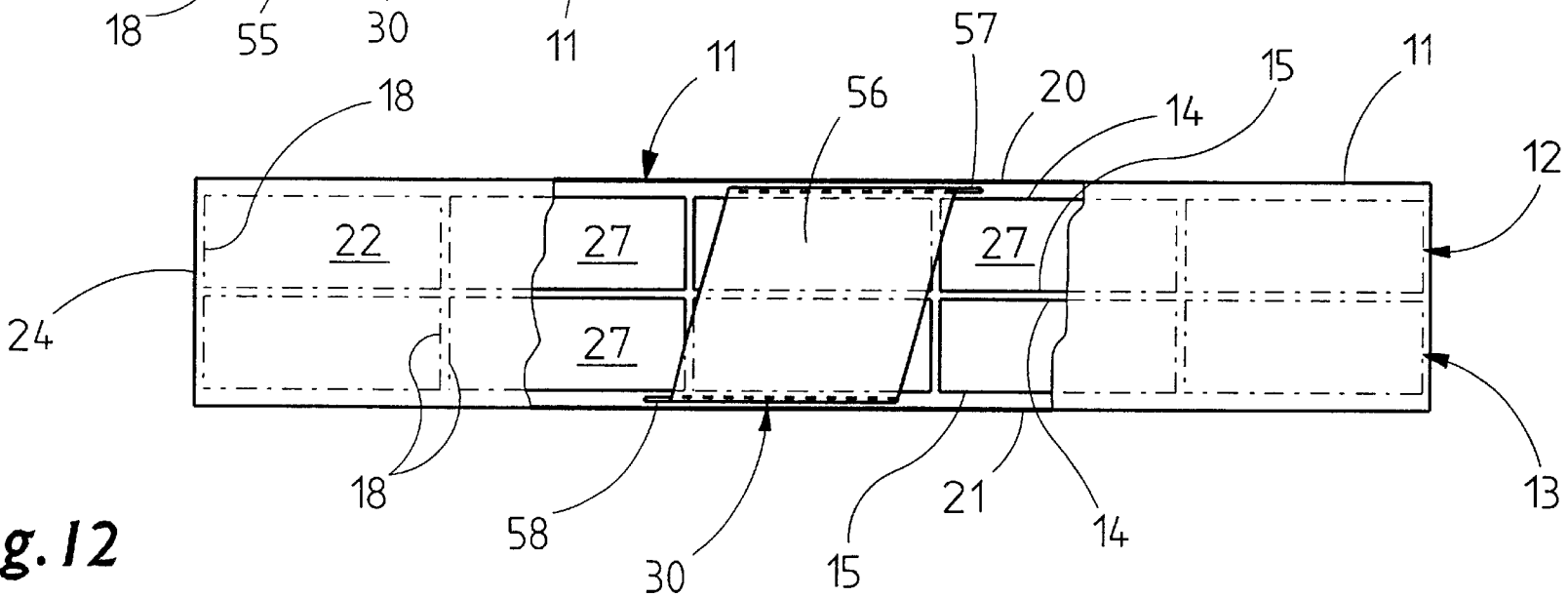
Figure 14:
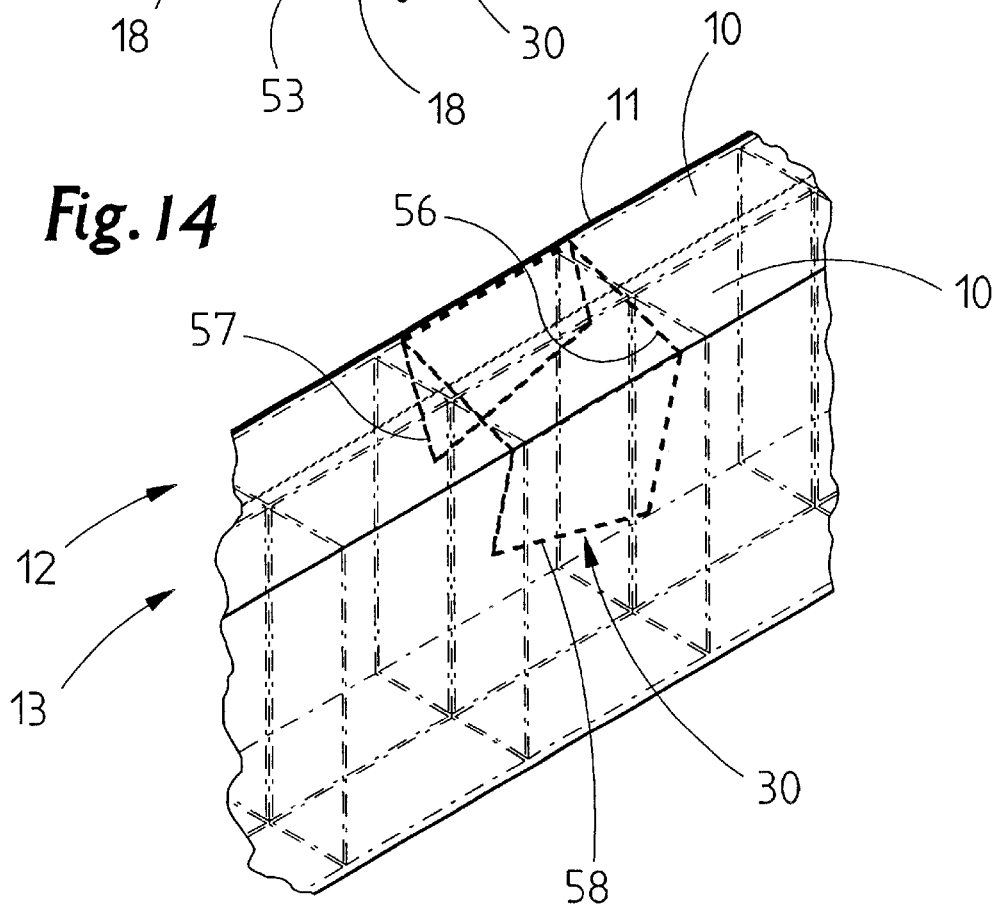

On the embodiment according to FIG. 12 and FIG. 14, a coupon 30 is positioned on the inner side, in the region of a long side, i.e. in the region of an (upper) side wall 22 of the outer wrapping 11. This coupon, also, is folded in rectangular fashion, stretched out and in a U-shape over the two rows of packets 12, 13. A web 56 extends in the region of the side wall 22, i.e. over the base surface or end surface of adjacent cigarette packets 10 of the two rows 12, 13. Arms 57, 58 are located in the region of the front side 14 or rear side 15, pointing outwards, of the relevant cigarette packets 10. A special characteristic consists in the fact that, on the embodiment of FIG. 12 and FIG. 14, the coupon 13 is positioned in an inclined position. Edges of the coupon 30 are arranged at an (acute) angle to the delimitations or surfaces of the cigarette packets 10. The coupon is preferably located in the middle of the side wall 22.

What is claimed is:

1. A packaging container containing a group of cigarette packs (10), comprising:

a) surrounding the group, an outer wrapping (11) made of paper, thin cardboard, foil or other packaging material;

b) a plurality of cigarette packs (10), each of which is cuboid in shape and has a large-surface front side (14) and large-surface rear side (15), narrow side surfaces (18), and a narrow bottom wall and a narrow top wall, c) wherein the packs (10) of the group are arranged in two rows (12, 13) extending in a longitudinal direction, adjacent packs (10) within each row (12, 13) abutting each other with their narrow side surfaces (18), and adjacent packs (10) from pack row (12) to pack row (13) abutting each other with their large-surface front (14) and rear (15) sides, and d) arranged within the outer wrapping (11), a separate coupon (30) which extends over at least two adjacent ones of said packs (10), the coupon positioned between the rows (12, 13) and extending in the direction of the rows.

2. The packaging container according to claim 1, wherein the coupon (30) lies on said large-surface front (14) or rear (15) sides of the packs.

3.The packaging container according to claim 2, wherein the coupon (30) extends over said front sides (14) or said rear sides (15) of three adjacent ones of said packs (10).

4. The packaging container according to claim 3, wherein the coupon is positioned approximately centrally between two rows (12, 13).

5. The packaging container according to claim 1, wherein five of said packs (10) are arranged in each of the rows (12, 13).

6. The packaging container according to claim 1, wherein the coupon (30) has a height slightly less than the height of each pack (10).

7. The packaging container according to claim 1, wherein the outer wrapping (11) is made of transparent film.

8. The packaging container according to claim 3, wherein the coupon (30) extends over only those packs (10) which are not arranged at a beginning or an end of a row (12, 13).

* * * * *